US010513880B2

(12) United States Patent
Dintheer et al.

(10) Patent No.: US 10,513,880 B2
(45) Date of Patent: Dec. 24, 2019

(54) FINGER PROTECTION DEVICE FOR A LEAF DOOR

(71) Applicant: Planet GDZ AG, Tagelswangen (CH)

(72) Inventors: Andreas Dintheer, Illnau (CH); Andreas Brändle, Hettlingen (CH)

(73) Assignee: PLANET GDZ AG, Tagelswangen (CH)

( * ) Notice: Subject to any disclaimer, the term of this patent is extended or adjusted under 35 U.S.C. 154(b) by 0 days.

(21) Appl. No.: 15/756,172

(22) PCT Filed: Jul. 26, 2016

(86) PCT No.: PCT/EP2016/067768
§ 371 (c)(1),
(2) Date: Feb. 28, 2018

(87) PCT Pub. No.: WO2017/036679
PCT Pub. Date: Mar. 9, 2017

(65) Prior Publication Data

US 2018/0245400 A1 Aug. 30, 2018

(30) Foreign Application Priority Data

Aug. 31, 2015 (EP) ..... 15183129

(51) Int. Cl.
*E06B 7/36* (2006.01)

(52) U.S. Cl.
CPC ..... *E06B 7/367* (2013.01); *E05Y 2800/41* (2013.01)

(58) Field of Classification Search
CPC ..... E06B 7/36; E06B 7/367; E05Y 2800/41
USPC ..... 49/383
See application file for complete search history.

(56) References Cited

U.S. PATENT DOCUMENTS

| | | | | | |
|---|---|---|---|---|---|
| 1,796,426 | A * | 3/1931 | Alewel | B60J 5/0495 | 160/100 |
| 2,910,741 | A * | 11/1959 | Dettman | E06B 7/367 | 16/250 |
| 5,419,084 | A * | 5/1995 | Sankey | E06B 7/367 | 16/250 |
| 6,477,809 | B1 * | 11/2002 | Dorner | E06B 7/367 | 49/383 |
| 2006/0101617 | A1 * | 5/2006 | Webb | E06B 7/367 | 16/250 |

FOREIGN PATENT DOCUMENTS

| | | | |
|---|---|---|---|
| DE | 3716654 | A1 | 12/1988 |
| DE | 202008016094 | U1 | 2/2009 |
| DE | 10 2015 108 765 | * | 8/2016 |
| GB | 2184690 | A | 3/1986 |
| GB | 2268562 | A | 1/1994 |
| NL | 8401100 | A | 11/1985 |

* cited by examiner

*Primary Examiner* — Gregory J Strimbu
(74) *Attorney, Agent, or Firm* — Browdy and Neimark, P.L.L.C.

(57) ABSTRACT

A finger protection device (S) includes a housing (2), a first fastener strip (4) and a web (1), wherein the housing can be fastened to a door frame (R), or to a door leaf (F), such that, when the device is used as intended, the web (1) covers a gap between the door leaf (F) and the door frame (R). A second fastener strip (3) can be connected to the first fastener strip (4) in order to tension the web (1) between the housing (2) and first fastener strip (4). The second fastener strip (3) can be hooked in the first fastener strip (4) in order to tension the web (1).

16 Claims, 4 Drawing Sheets

FINGER PROTECTION DEVICE FOR A LEAF DOOR

TECHNICAL FIELD

The present invention relates to a finger protection device for a leaf door.

PRIOR ART

Doors carry a high risk of accidents, in particular for small children. It is a frequent occurrence that fingers are trapped between the door leaf and the door frame. The forces acting on the trapped fingers are high, and the resulting injury is severe.

Devices are known from the prior art, therefore, which are intended to provide protection against inadvertent trapping of the fingers. In one variant, the gap between the secondary closing edge of the door leaf on the opposing hinge side and the door frame is covered by a textile protective roller blind which is fastened, on the one hand, to the door frame and, on the other hand, to the door leaf.

Such a protective roller blind is disclosed, for example, in GB 2 164 690. The roller blind housing which contains a shaft for winding up the textile roller blind is provided with a slot nut. A V-shaped holder is attached to the door frame, the slot nut being able to be introduced therein in order to hold the housing. The free edge of the roller blind web is provided with a stiff end strip which is screwed to the door leaf. Thus merely the housing but not the end strip is able to be easily released.

DE 37 16 654 also discloses a roller blind as finger protection, wherein the roller blind housing is screwed to the door frame. The free edge of the roller blind is held in a groove of a strip which is screwed to the door leaf. This device has the drawback that the fastening screws are visible and freely accessible. Therefore, the screws interfere with the appearance of the door. Additionally, the screws may be easily released which encourages unauthorized tampering. The latter may be fatal, in particular in public buildings, such as for example in schools or nurseries.

In DE 20 2008 016 094 U, tampering by releasing the screw connections is intended to be prevented and the mounting is intended to be simplified. In this case, therefore, holders are provided both on the door frame side and on the door leaf side, said holders being screwed to the door frame and/or the door leaf. The housing of the roller blind and the free edge of the roller blind are arranged in fastening means which may be latched into this holder and which cover the fastening screws.

This device has the drawback that a release of the connection is only possible by using a specific tool. Additionally, there is the risk that the holder or the fastening means is destroyed when released. Moreover, a re-adjustment of the holder is no longer possible since the fastening means cover the screws by which the holders are securely screwed to the door leaf and to the frame.

DESCRIPTION OF THE INVENTION

It is an object of the invention, therefore, to provide a finger protection device which permits rapid mounting and, in spite of concealed fastening means, an alignment and re-adjustment of the roller blind.

The finger protection device according to the invention for a leaf door has a roller blind which has a housing, a first fastening means and a web. The roller blind can be fastened to a door frame and to a door leaf of the leaf door by means of the housing and the first fastening means, with the result that, when the device is used as intended, the web covers a gap between the door leaf and the door frame. The web has at its free edge an end strip which is held in a second fastening means, wherein the second fastening means can be connected to the first fastening means in order to tension the web between the housing and the first fastening means. The second fastening means is a suspension unit which can be suspended in the first fastening means in order to tension the web, whereby the fastening of the second fastening means to the first fastening means is able to be released again without the use of tools and in a non-destructive manner.

Since the web is able to be suspended together with the second fastening means, the device is able to be mounted easily and rapidly. The device may also be dismantled again in a simple manner, for example when the door leaf has to be taken off its hinges.

In contrast to devices in which the fastening means has to be plugged on or latched in a clamped manner, the suspended connection is able to be released again non-destructively and without tools. The suspended connection according to the invention may also be released and re-adjusted during the mounting as often as desired and in a very simple manner.

Moreover, the screws are instantly freely accessible. As a result, a re-adjustment of the device is simplified. Moreover, no material fatigue is present even after being repeatedly released, so that the fastening means is not at risk of being damaged.

Additionally, the simplest shapes may be used for the fastening means, so that the production costs are minimized.

This device is suitable, in particular, for use on the secondary closing edge on the opposing hinge side of a door leaf. However, it may also be used on the secondary closing edge on the hinge side. It may be used equally for rebated and non-rebated leaf doors.

Preferably, the first fastening means comprises a hook receiver and the second fastening means comprises a suspension hook or vice versa. This simplifies the suspension. Alternative arrangements, however, are possible.

Preferably, the first fastening means comprises a fastening surface for fastening the first fastening means to the door frame or to the door leaf, wherein the second fastening means is able to be suspended approximately in the direction parallel to this fastening surface.

The suspension in this direction facilitates a re-adjustment of the second fastening means in its vertical position relative to the first fastening means. In other words, the end strip of the roller blind may be displaced vertically and thus the web may be aligned in a vertical plane at an angle. This angled alignment prevents the web, in particular when it is produced from a textile material, from creasing when the door is opened and closed.

It is also advantageous if the adjustment in the horizontal direction is able to take place separately from the adjustment in the vertical direction.

Moreover, the suspension in this direction permits the formation of optimally narrow first and second fastening means.

In preferred embodiments, the second fastening means is a hook-shaped suspension strip which extends in its length approximately over the entire width of the web. The width of the web in this text is measured in the vertical direction and thus in the direction transversely to the pull-out direction of the roller blind, i.e. along the height of the door frame and the door leaf. Also, the first fastening means is preferably a fastening strip which extends in its length approximately over the entire width of the web. Preferably, the web extends over approximately the entire height of the door leaf.

In one embodiment, the first and/or second fastening means only extend partially over the entire width of the web. In preferred embodiments, however, the second fastening means is suspended over approximately its entire length in the first fastening means and preferably the first and second fastening means extend over approximately the entire width and/or height of the web.

Preferably, the second fastening means is able to be adjusted in the longitudinal direction, i.e. in its vertical mounting position, relative to the first fastening means. Preferably, the second fastening means is able to be fixed in its vertical position relative to the first fastening means.

Preferably, the first fastening means is able to be fastened by at least one first fastening element to the door leaf or to the door frame, and in the tensioned state when used as intended the web covers the at least one first fastening element. Preferably, in the suspended state the suspension unit is laterally spaced apart from the first fastening means. Thus the web protects the at least one fastening element from being tampered with. On the other hand, it is easily accessible as soon as the web is unhooked.

Preferably, the first fastening element has at least one slot extending transversely to the longitudinal direction of the fastening element, wherein the first fastening element is at least one screw which is able to be passed through the slot for fastening the first fastening means to the door leaf or to the door frame. As a result, the first fastening element may be displaced in the direction transversely to the door frame or door leaf. This slot is preferably covered by the tensioned web but is exposed when the web is not suspended. A simple mounting and a simple re-adjustment of the device are thus possible.

In preferred embodiments, the first fastening means is configured to be substantially plate-shaped and has an undercut for receiving the suspension unit.

In a preferred embodiment, the housing has a base body for receiving the web and a projection protruding laterally from the base body, wherein the projection serves for fastening the housing to the door leaf or to the door frame, and wherein when used as intended the web covers the projection in the tensioned state. This projection preferably also has holes, in particular slots, in order to mount the housing by means of screws. The projection and the screws are also exposed when the web is not suspended and otherwise they are covered by the web. This in turn also simplifies the mounting and the re-adjustment.

Preferably, the second fastening means is able to be altered in its position relative to the first fastening means, preferably also in the suspended state. Preferably, the second fastening means may be suspended at any height in the first fastening means. Preferably, even in the suspended state the second fastening means may be displaced in the vertical direction. This also simplifies the re-adjustment.

In preferred embodiments, at least one second fastening element is present, the second fastening means being able to fixed thereby in its position relative to the first fastening means. This at least one second fastening element is preferably a setscrew which is inserted from outside through the second fastening element and protrudes over the first fastening element so that a further displacement in the vertical direction is impossible and the second fastening element is blocked in its position in the vertical direction. Generally, this at least one second fastening means also prevents the fastening strip from being unhooked.

Preferably, the second fastening means has a substantially U-shaped cross section with a first limb, a second limb and a web connecting the two limbs, wherein the first limb serves for the suspension and the second limb is lengthened relative to the first limb and has an outwardly oriented groove in which the end strip is inserted. This is a shape which is able to be produced easily and which additionally has the advantage that it is relatively small and narrow and thus does not interfere with the appearance of the door.

Preferably, the first fastening means has a base body in the shape of a plane-parallel stop plate having a first and a second surface, wherein an inner face of the second fastening means bears against the first surface in the suspended state, wherein the stop plate on a longitudinal side transitions into a suspension plate which is configured to be thinner than the stop plate and forms an undercut and wherein the stop plate on its opposing longitudinal side transitions into a fastening plate for fastening the first fastening means to the door leaf or to the door frame. This is also a relatively cost-effective and slim design.

The stability of the suspended connection is additionally increased when the suspension plate on its free longitudinal side has a protruding nose which in the suspended state of the second fastening means projects from an inner wall of the second fastening means. This prevents the tilting or wobbling of the fastening means relative to one another.

If the stop plate bears against an inner face of the second limb, the tilting or wobbling of the fastening means is additionally or alternatively avoided.

Preferably, the housing is fastened to the door leaf and the first fastening means is fastened to the door frame. This increases the free access through the door frame when the door leaf is taken off its hinges.

Further embodiments are disclosed in the dependent claims.

BRIEF DESCRIPTION OF THE DRAWINGS

A preferred embodiment of the invention is described hereinafter with reference to the drawings, which merely serve for the description thereof and are not to be interpreted as limiting. In the drawings.

DESCRIPTION OF THE PREFERRED EMBODIMENTS

Figure 1:
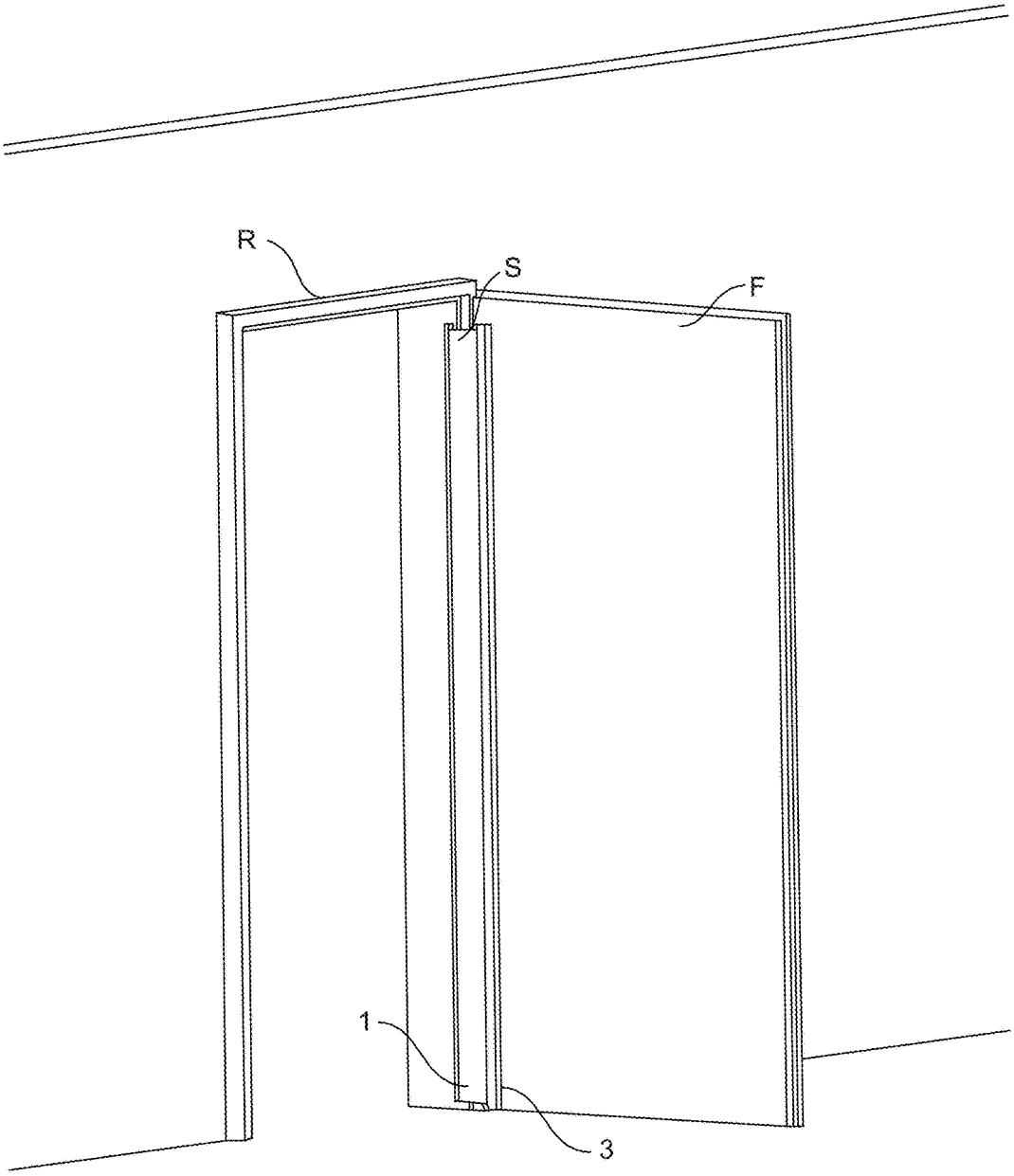
FIG. 1 shows a perspective view of a door with a finger protection device according to the invention.

A preferred exemplary embodiment is shown in FIGS. 1 to 7. FIG. 1 shows a door having a door frame R and a door leaf F. The door hinge B in this figure is not visible but is covered by the finger protection device S according to the invention. As may be identified in FIG. 1, the finger protection device S extends approximately over the entire height of the door leaf F and thus bridges the gap which is produced between the door frame R and the door leaf F when the door is open.

Figure 2:
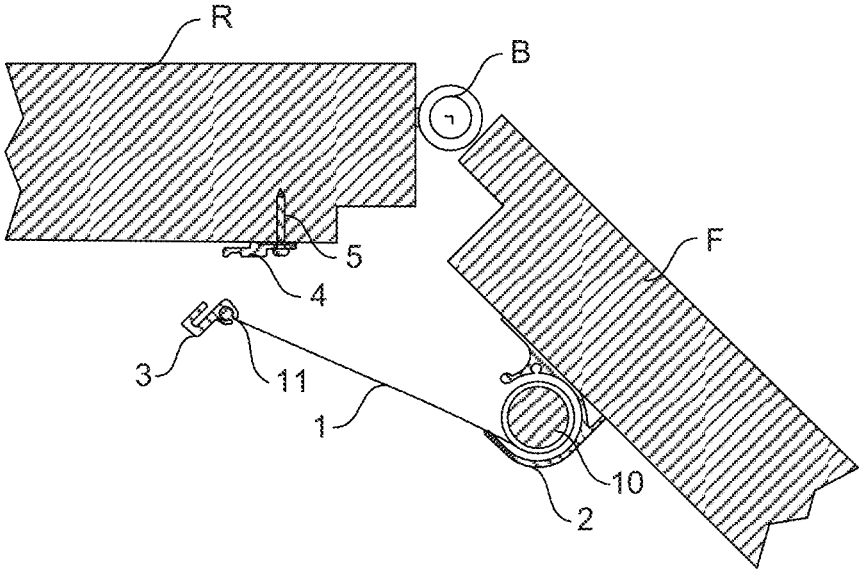
FIG. 2 shows a cross section through a part of the door according to FIG. 1 with the door leaf open and the roller blind web not yet suspended.
Figure 3:
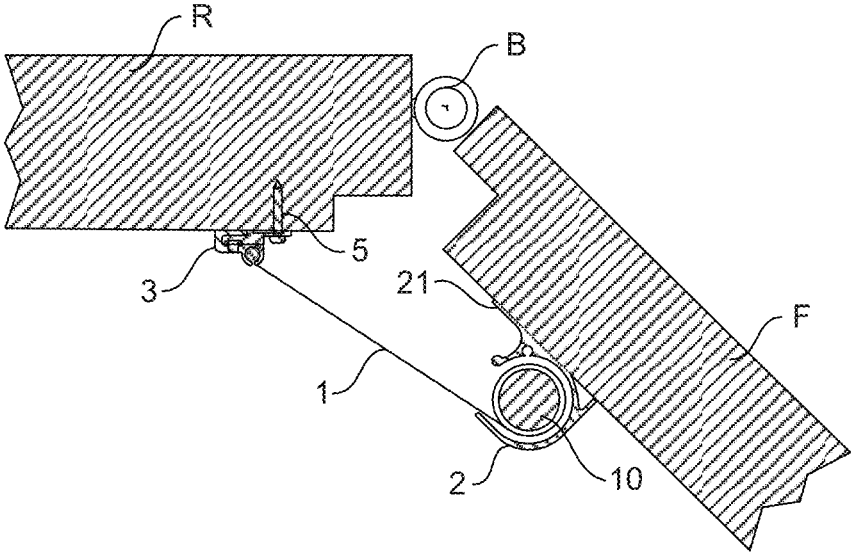
FIG. 3 shows the door according to FIG. 2 with the suspended roller blind web.

In FIGS. 2 and 3 a cross section is shown through a part of FIG. 1, so that the finger protection device S according to the invention may be identified more clearly.

The finger protection device substantially consists of a roller blind. A shaft 10 is arranged in a roller blind housing 2. A roller blind web 1 is wound onto the shaft 10. The web 1 preferably consists of a textile material. The shaft 10 is spring-loaded so that an unwound part of the web 1 is automatically pulled back. This arrangement is sufficiently known from the prior art.

The free edge of the web 1 is reinforced by an end strip 11. This may be implemented by thickening the web 1 itself. Generally, however, the edge is connected to a metal or plastic strip. This end strip 11 is in a suspension strip 3 which is configured to be hook-shaped.

The housing 2 of the roller blind is preferably fastened to the door leaf F. However, it may also be arranged on the door leaf F. A fastening strip 4 as the first fastening means is screwed onto the counterpart of the door, therefore, in this case onto the door frame R. The suspension strip 3 forms a second fastening means which may be suspended in the first fastening means. This is clearly identifiable in FIGS. 2 and 3. Due to the restoring force of the roller blind, in the suspended state the web 1 is tensioned in every position of the door leaf F. It covers the gap in each case between the door frame R and the door leaf F. The web 1, therefore, provides protection from accidents on the side located opposite the hinge B.

Figure 4:
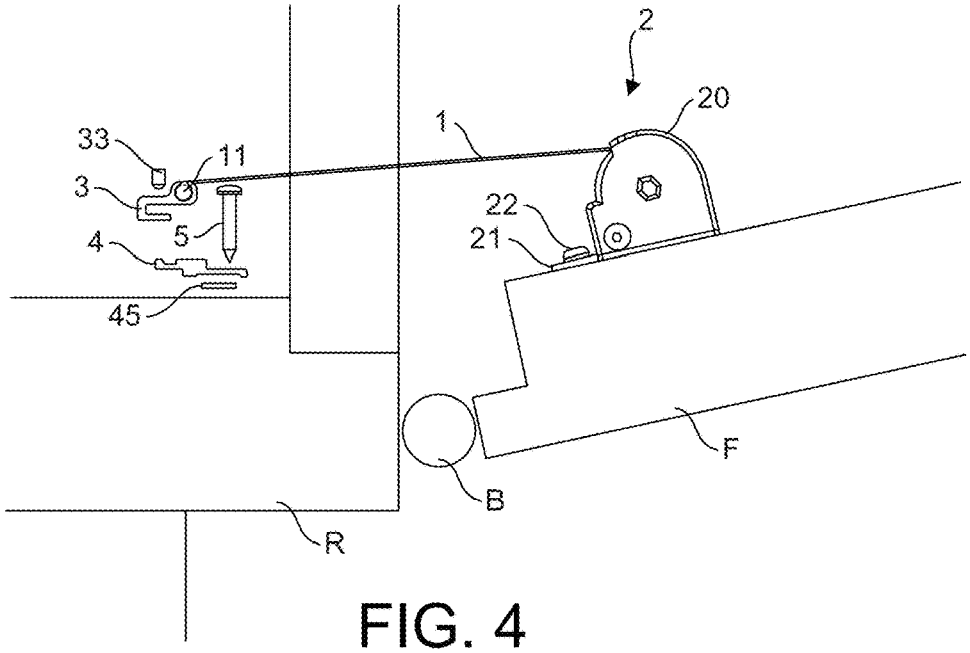
FIG. 4 shows a view of a part of the door according to FIG. 1 with a partially exploded view of the finger protection device according to the invention.
Figure 5:
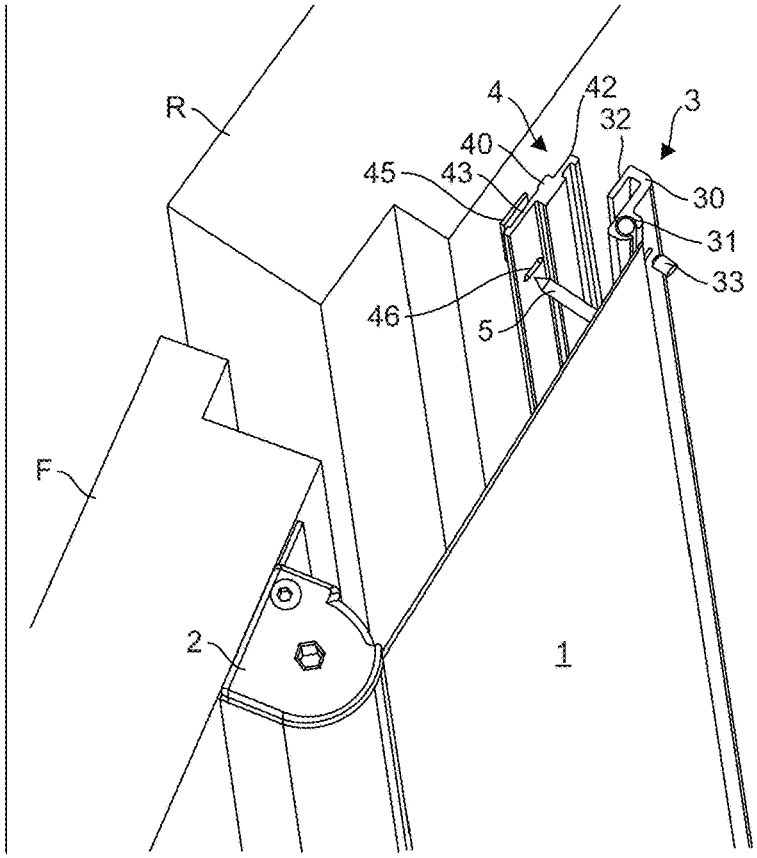
FIG. 5 shows a perspective view from above of a part of the door according to FIG. 1 with the partially suspended finger protection device.
Figure 6:
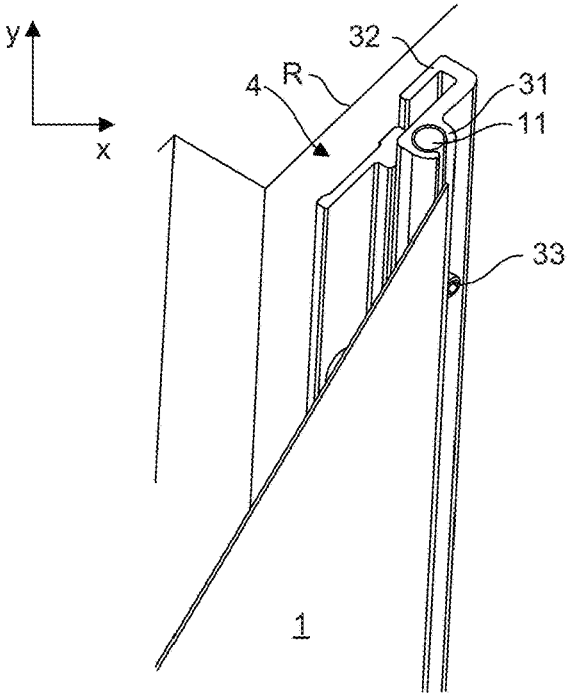
FIG. 6 shows a view of a part of the door according to FIG. 5 with the suspended roller blind web in a first position and FIG. 7 shows a view of a part of the door according to FIG. 5 with the suspended roller blind web in a second position.
Figure 7:
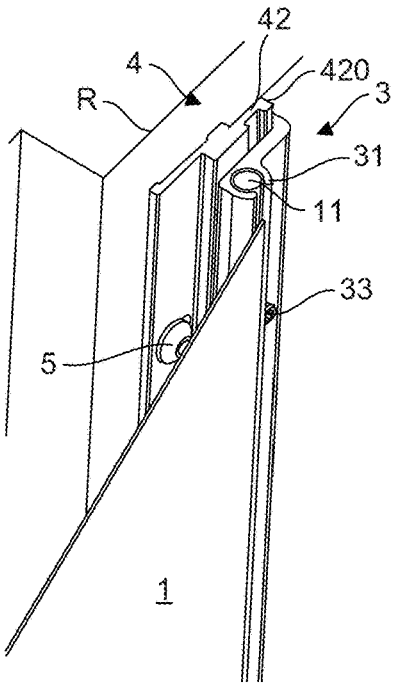

In FIGS. 4 and 5 it is able to be clearly identified how the finger protection device S according to the invention is mounted. Firstly, the housing 2 is fastened by at least one first screw 22 to the door leaf F and subsequently the fastening strip 4 is mounted.

The housing 2 has a base body 20 in which the shaft 10 and the wound-up web 1 are held. The base plate of the base body 20, by which the housing 2 bears against the door leaf F, is lengthened in a projection 21. This projection 21 is formed by a strip which preferably extends over the entire length of the base body 20. In alternative embodiments, the projection 21 is formed by two or more tabs which extend away from the base body 20. This projection 21 may be fastened by the at least one first screw 22 to the door leaf. Preferably a plurality of first screws 22 are present. As a result, the housing 2 is fixed to the door leaf F. Further fastenings, for example on the side of the base body 20 opposing the projection 21, are not necessary. Depending on the shape and size of the housing 2, however, even more fastenings may be present.

The first fastening means, in this case the fastening strip 4, is fastened on the opposing side of the finger protection device S, i.e. on the door frame R. This fastening strip 4 preferably also extends approximately over the entire length of the door frame R. The fastening strip is preferably configured, in particular, to be the same length as the housing 2.

The web 1 is fixedly held by the end strip 11 in the suspension strip 3. To this end, the suspension strip 3 has a base body 30 which has a substantially U-shaped cross section. A first limb 32 of the U-shaped base body 30 forms a suspension hook. A second limb of longer configuration has at its free end a groove 31. This groove is configured as a holder. The opening of the groove 31 is located on the side of the second limb opposing the suspended hook 32 and is oriented outwardly. The groove 31 preferably extends over the entire length of the suspension strip 3. The suspension strip 3 is preferably configured to be of equal length with the fastening strip 4 and the housing 2. At least the suspension strip 3 and the groove 31 are configured to be of equal length with the web 1.

The end strip 11 is inserted into the groove 31. The end strip is pivotably held therein.

The fastening strip 4 has a stop plate 40. On a longitudinal side of the stop plate 40, said stop plate transitions integrally into a suspension plate 42. The suspension plate 42 is configured to be thinner than the stop plate 40. The suspension plate 42 has a projection and/or a nose 420 oriented vertically away from the door frame R. On the opposing side of the suspension plate 42, the stop plate 40 transitions integrally into a fastening plate 43. The fastening plate 43 is preferably configured to be thinner than the stop plate 40. The fastening plate preferably has at least one slot 46, preferably a plurality of slots 46. The slots 46 extend in the direction transversely to the longitudinal direction of the fastening strip 4, i.e. in the horizontal direction when the finger protection device S is suspended.

The fastening strip 4 is fixedly screwed to the door frame R by means of at least one third screw 5. The slots 46 permit in this case a horizontal displacement of the fastening strip 4 without new holes having to be drilled.

The stop plate 40 bears with its rear face flat against the door frame R. An adhesive mounting strip 45, which is preferably arranged to the rear of the fastening plate 43, simplifies the mounting. The adhesive mounting strip 45 may extend, but does not have to extend, over the entire length of the fastening strip 4. The suspension plate 42 forms an undercut in the suspended state of the fastening strip 4. The suspension hook 32 of the suspension strip 3 engages in this undercut, wherein the suspension strip 3 is able to be suspended at different heights and the angle of the roller blind web 1, therefore, may be easily varied. This is clearly identifiable in FIGS. 6 and 7. In the suspended state, the front planar surface of the stop plate 40 bears against the inner face of the second limb of the suspension strip 3. The nose 420 also bears against this inner face so that wobbling is prevented.

The suspended suspension strip 3 may be fixed in its vertical position by means of one or more second screws 33. The at least one second screw 33 is preferably a setscrew which is pressed onto the suspension plate 42 by the second limb of the fastening strip 3.

The web 1 may be unhooked easily by this second screw 33 being slightly released.

As may be clearly identified in FIG. 3, in the suspended state the web 1 covers the projection 21 with the first screw 22 and also the fastening plate 43 with the third screw 5. Since the web 1 is not able to be unhooked easily without releasing the second screw 33, the fastening screws 22 and 5 are well protected from tampering.

If the web 1 is unhooked, however, these screws 22, 5 are easily accessible and a re-adjustment of the finger protection device in the already suspended state may be carried out in a simple manner.

It is particularly advantageous if the adjustment takes place in the horizontal X-direction and the vertical Y-direction by separate means. As already mentioned above, due to the slots 46 the fastening strip 3 may be displaced in the horizontal direction. Due to the suspension strip 3 which is displaceable in the vertical Y-direction, it is possible for the alignment of the web 1 to be optimally adjusted. It is also advantageous that this vertical adjustment is able to take place even when the door leaf is repeatedly opened and closed, in order to find the optimal position. For the fixing, as mentioned above on both sides, only the at least one second screw 33 has to be screwed in.

The finger protection device according to the invention is thus of robust construction, it consists of the simplest means and nevertheless allows optimal protection against tampering and a maximum degree of re-adjustability. Moreover, it has an attractive design.

LIST OF REFERENCE NUMERALS

1 Web
10 Shaft
11 End strip
2 Housing
20 Base body
21 Projection
22 First screw
3 Suspension strip
30 Base body
31 Groove
32 Suspension hook
33 Second screw
4 Fastening strip
40 Stop plate
42 Suspension plate
420 Nose
43 Fastening plate
45 Adhesive mounting strip
46 Slot
5 Third screw
B Hinge
F Door leaf
R Door frame
S Finger protection device

The invention claimed is:

1. A finger protection device for a leaf door assembly, the finger protection device comprising a roller blind and a fastening strip, wherein the roller blind comprises a web, a housing and a hook, wherein the roller blind can be fastened to a door frame of the leaf door assembly by one of the housing and the fastening strip and to a door leaf of the leaf door assembly by the other one of the housing and the fastening strip, such that in use the web covers a gap between the door leaf and the door frame, wherein the web has a free edge comprising an end strip which is held in the hook, wherein the hook can be connected to the fastening strip in order to tension the web between the housing and the fastening strip, wherein the hook can be hooked in the fastening strip in order to tension the web, whereby the hook, when hooked to the fastening strip, is able to be released from the fastening strip without using tools and in a non-destructive manner.

2. The finger protection device as claimed in claim 1, wherein the fastening strip is a hook receiver.

3. The finger protection device as claimed in claim 1, wherein the fastening strip comprises a fastening surface for fastening the fastening strip to a respective one of the door frame and the door leaf, wherein the hook is able to be hooked in the fastening strip in a direction approximately parallel to the fastening surface.

4. The finger protection device as claimed in claim 1, wherein the hook is a hook-shaped strip having a height approximately equal to a height of the web.

5. The finger protection device as claimed in claim 1, wherein the fastening strip has a height approximately equal to a height of the web.

6. The finger protection device as claimed in claim 5, wherein the hook is a hook-shaped strip having a height approximately equal to the height of the web and wherein the hook is hooked to the fastening strip approximately along an entirety of the height of the fastening strip.

7. The finger protection device as claimed in claim 1, wherein the fastening strip is able to be fastened to a respective one of the door leaf and the door frame by at least one fastener, and wherein, when the web is tensioned between the housing and the fastening strip in use, the web covers the at least one fastener, and wherein, when the hook is hooked in the fastening strip, the hook is laterally spaced apart from the fastener.

8. The finger protection device as claimed in claim 7, wherein the fastening strip has a slot extending transversely to a longitudinal axis of the fastening strip, and wherein the fastener is at least one screw which is able to be passed through the slot for fastening the fastening strip to the respective one of the door leaf and the door frame.

9. The finger protection device as claimed in claim 1, wherein the housing has a base body for receiving the web and a projection protruding laterally from the base body, wherein the projection is for fastening the housing to the respective one of the door leaf and the door frame, and wherein the web, when the web is tensioned between the housing and the fastening strip in use, covers the projection.

10. The finger protection device as claimed in claim 1, wherein the hook is movable relative to the fastening strip.

11. The finger protection device as claimed in claim 10, wherein the hook is movable relative to the fastening strip when the hook is hooked to the fastening strip.

12. The finger protection device as claimed in claim 1, wherein the hook is vertically movable relative to the fastening strip.

13. The finger protection device as claimed in claim 1, wherein the hook is able to be fixed relative to the fastening strip with a fastener.

14. The finger protection device as claimed in claim 13, wherein the hook is able to be fixed in a vertical position relative to the fastening strip.

15. The finger protection device as claimed in claim 1, wherein the fastening strip has an undercut for receiving the hook.

16. The finger protection device as claimed in claim 1, wherein the hook has a substantially U-shaped cross section with a first limb, a second limb and a web connecting the two limbs, wherein the second limb is longer than the first limb and has a groove in which the end strip is inserted.

* * * * *